US007775203B1

(12) United States Patent
Patrick

(10) Patent No.: US 7,775,203 B1
(45) Date of Patent: Aug. 17, 2010

(54) STAND ASSEMBLY FOR SUPPORTING FREE-STANDING OBJECTS

(76) Inventor: Jerry Dale Patrick, P.O. Box 398, Escatawpa, MS (US) 39552

( * ) Notice: Subject to any disclaimer, the term of this patent is extended or adjusted under 35 U.S.C. 154(b) by 577 days.

(21) Appl. No.: 11/709,507

(22) Filed: Feb. 22, 2007

Related U.S. Application Data

(60) Provisional application No. 60/798,509, filed on May 8, 2006.

(51) Int. Cl.
*F24C 5/20* (2006.01)

(52) U.S. Cl. ..... 126/38; 248/165; 248/529

(58) Field of Classification Search ..... 248/150, 248/166, 167, 188.6, 528, 188.7, 529, 165; 126/38, 40, 260, 25 R, 9 B, 9 R; 99/340, 99/413; 403/377, 13, 14
See application file for complete search history.

(56) References Cited

U.S. PATENT DOCUMENTS

| | | | | | |
|---|---|---|---|---|---|
| 2,706,609 | A | * | 4/1955 | Sullivan | 248/167 |
| 3,719,340 | A | * | 3/1973 | Norton | 248/523 |
| 3,955,787 | A | * | 5/1976 | Brown | 248/159 |
| 4,177,790 | A | | 12/1979 | Zenzaburo | |
| 4,288,052 | A | | 9/1981 | Scott | |
| 4,406,437 | A | | 9/1983 | Wright | |
| 4,454,859 | A | * | 6/1984 | Vincent | 126/38 |
| 4,508,095 | A | | 4/1985 | Bloechel | |
| 4,712,758 | A | * | 12/1987 | Cuschera | 248/188.7 |
| 4,726,350 | A | | 2/1988 | Steinhauser | |
| 4,763,866 | A | | 8/1988 | Sinchok | |
| 5,065,735 | A | | 11/1991 | Bouregeois | |
| 5,117,808 | A | | 6/1992 | Peters | |
| 5,236,167 | A | | 8/1993 | Tai | |
| D342,694 | S | | 12/1993 | Frost | |
| 5,482,245 | A | | 1/1996 | Graves | |
| 5,813,321 | A | | 9/1998 | Bouregeois | |
| 5,884,553 | A | | 3/1999 | Morris | |
| 5,970,852 | A | | 10/1999 | Bourgeois | |
| 6,003,506 | A | * | 12/1999 | Long et al. | 126/38 |
| 6,058,830 | A | | 5/2000 | Bourgeois | |
| 6,102,027 | A | * | 8/2000 | Tilby | 126/38 |
| 6,293,512 | B1 | | 9/2001 | Ho | |
| 6,957,649 | B1 | * | 10/2005 | Bourgeois | 126/40 |

* cited by examiner

*Primary Examiner*—Korie Chan
(74) *Attorney, Agent, or Firm*—Neil F. Markva

(57) ABSTRACT

A stand assembly for supporting vertically disposed free-standing objects and comprises a hub section including a hollow inner sleeve portion and a hollow outer sleeve portion effective for removably receiving the inner sleeve portion. Support leg members are fixedly connected to the hub section and radially extend outwardly therefrom for upholding the hub section in a vertical disposition. In a specific embodiment, the stand assembly includes a fuel burner wherein the inner bore of the inner sleeve portion defines a combustion chamber and container support top portions of the leg members for supporting a cooking container over a flame in the hub section. In another embodiment, the inner bore has a size and shape that is effective to receive a lower end section of a vertically disposed object having a vertical support member selected from the group consisting of a tree trunk, a sign post, a flag pole, a display rack and the like.

19 Claims, 11 Drawing Sheets

STAND ASSEMBLY FOR SUPPORTING FREE-STANDING OBJECTS

RELATED APPLICATION

This is a non-provisional application for which priority is claimed in Provisional Application No. 60/798,509 filed May 8, 2006.

BACKGROUND OF THE INVENTION

1. Field of the Invention

This invention relates to collapsible or knock-down stand assemblies that support free-standing objects in a generally vertical orientation such as cooking pots, Christmas trees, flag poles, sign posts, display racks, and the like. More particularly, the invention relates to collapsible or knock-down support stand assemblies for outdoor cooking burners for cooking pots or for other vertically oriented items wherein support assembly components slidingly fit together without tools.

2. Background Description

Collapsible or knock-down burner or stove support stands and stand assemblies for Christmas trees, flag poles, sign posts, and display racks are known. Some are separable into individual sections, others are foldable into a storage position, and others are partially separable and foldable. U.S. Pat. Nos. 4,454,859; 4,508,095; 4,726,350; 5,236,167; and 6,102,027 exemplify such stand assemblies wherein their various parts break down into sections that may be separately stowed in storage and/or carried while camping and hiking.

Of particular interest are commercially available outdoor cookers that include a metallic frame that supports a burner nozzle, such as a cast iron burner nozzle. Such burner nozzles are commercially available and are used to fire most natural gas-fired hot water heaters. Examples of these prior art outdoor cooking devices are shown in U.S. patents that relate to burners and related cooking containers for boiling, steaming, or deep fat frying food items such as a whole turkey or chicken. U.S. Pat. Nos. 5,065,735; 5,813,321; 5,970,852; and 6,058,830 feature different primary burner assembly structures that elevate burner frames for supporting such cooking containers.

A disadvantage of these commercially available outdoor cookers that use gas such as propane or butane for heating the large pots filled with heavy cooking fluid is the amount of space required to store them when not in use. Foldable fuel cookers as shown in U.S. Pat. Nos. 4,177,790; 5,117,808; and 5,884,553 each have three support members that include a leg section that rests on a support surface and an upper pot supporting section for bearing a cooking pot. At least two of the support members are pivotally mounted to a hub member or the outer surface of a burner pipe. These prior art burners are designed to be carried on camping and hiking trips and are not particularly useful in supporting such large cooking pots that might easily tip over when resting on the pivotally mounted leg members.

U.S. Pat. Nos. 2,706,609; 5,482,245; and Des. 342,694 disclose cylindrical sleeve portions that are rotatable with respect to each other and have leg members disposed on the outer surface of an inner sleeve portion. The outer portion includes downwardly directed recesses into which end sections of a leg member or tree positioning eye bolts fit to preclude rotation of the assembled legs and cylinders with respect to each other.

U.S. Pat. No. 4,288,052 discloses a collapsible stand having two sets of opposed legs extending radially from a tubular hub support. The stand collapses or sets up by rotating one set of legs relative to the other set of legs about the hub support until the legs are at 90° to each other. Each leg includes an elongated rod folded back on itself to present vertically spaced inner ends that are secured to discs mounted on the hub support. An outer center portion of the back-folded rod engages the floor and serves as a foot for the stand. The inner ends of the legs are sandwiched between a pair of discs movably and rotatably mounted on the tubular hub support. Two pairs of locking tabs extend upwardly from each lower disc with each pair of tabs being spaced apart to define a leg receiving slot therebetween. The inner ends of the legs are each disposed between a pair of tabs to provide a firm and stable support. The resiliency of the back-folded rods of the inner support element urges the rod ends into the slots between the tabs, and squeezing of the inner ends of the rods shifts them from the leg receiving slots to allow collapsing of the legs to positions adjacent each other.

U.S. Pat. No. 4,406,437 discloses a support base for a display rack that knocks-down easily for compact shipment and storage without sacrifice of strength and durability when assembled for use. The parts fit together without the need for tools and a single locking set screw requires tightening. A hub section includes two sleeves having opposed leg members welded to their outer surfaces. The sleeves may be rotated with the legs stored in a folded position or completely separated into two sleeve and leg sections. The double telescoping sleeve arrangement imparts strength and stability to the support base.

U.S. Pat. No. 4,763,866 discloses a support stand having two sets of opposed legs extending radially from a hollow sleeve hub support, and collapses to a closed position where adjacent legs are substantially parallel from an open position where adjacent legs are substantially perpendicular to one another. A pair of opposed legs form an integral unit with a hollow cylindrical center joining the two legs. Upper and lower circular collars fit about upper and lower ends of the cylinder and caps hold the circular collars in place and secure the stand while allowing pivotal movement to the closed position.

U.S. Pat. No. 6,293,512 discloses a collapsible support frame including an inner tube, an outer tube, and a plurality of support legs fastened to the inner and outer tubes. The inner tube rotatably fits into the outer tube so that folding and unfolding of the support legs are attained by rotating the inner tube. A leg end section is disposed in an L-shaped groove and when lifting the inner tube to be rotated, the groove allows the leg end to come into its circumferential section. The inner tube has a hollow interior for holding a Christmas tree, a flag pole, and the like.

PURPOSE OF THE INVENTION

A primary object of the invention is to provide a support stand assembly that is easy to assemble and dissemble without tools and once assembled it stays fixed in place in an operational position without fastening means for supporting a free-standing object.

Another object of the invention is to provide a support stand assembly that may be assembled by slidingly interconnecting two hollow sleeve portions having rigidly attached opposed leg members wherein the interconnected sleeve portions form a hub section that remains rigid and true without movement while in use.

A further object of the invention is to provide a collapsible or knock-down support stand assembly including a hub section fixed to two pairs of opposed leg members having a structural configuration that is effective to support free-standing objects in a generally vertical orientation including cooking pots, flag poles, Christmas trees, sign posts, display racks, and the like.

Still another object of the invention is to provide a support stand assembly that quickly comes apart into two components from a fixed operating position to a slim line storage position by simply pulling the components apart and laying one component on top of the other or slipping them individually or side-by-side into a box or other storage space.

SUMMARY OF THE INVENTION

The stand assembly of the invention supports vertically disposed free-standing objects, and comprises a hub section including a hollow inner sleeve portion and a hollow outer sleeve portion each portion having an upper open end and a lower open end, the hollow inner sleeve portion having a first bore and a first outer peripheral surface, and the hollow outer sleeve portion having a second outer peripheral surface and a second bore effective for removably receiving the inner sleeve portion whereby said inner and outer sleeve portions may be separated. The assembly further comprises support leg means including inner end sections fixedly connected to the outer peripheral surfaces of the hollow inner and outer sleeve portions of the hub section for upholding the hub section in a vertical disposition.

The support leg means includes a first set of opposed leg members having first inner end sections that are fixed to the first outer peripheral surface of the inner sleeve portion and radially extend outwardly therefrom, and a second set of opposed leg members having second inner end sections that are fixed to the second outer peripheral surface of the outer sleeve portion and radially extend outwardly therefrom. The outer sleeve portion includes a pair of opposed slots that are peripherally spaced from the second set of opposed leg members by about 90°; extend upwardly from the lower end of the outer sleeve portion; and have a width effective to slidingly receive the first single inner end sections of the first set of opposed leg members. Thus, no substantial play exists between the slots and the first inner end sections of the first set of opposed leg members to form a four-legged support structure when assembled in an operational position with the inner sleeve portion located within the outer sleeve portion and the entire first single inner end sections of the first set of opposed leg members are disposed within the pair of opposed slots. The inner sleeve portion is the male section and the outer sleeve portion is the female section of the assembly. The stand assembly of the invention is effective to be assembled and disassembled without tools and once assembled the assembly stays fixed in place in an operational position without fastening means for supporting a free-standing object.

In a specific embodiment, the inner and outer sleeve portions are cylindrical with the outer circumferential surface of the male section having an outer diameter of a length sufficient for the male section to slidingly fit into the second bore of the female section so that no play exists between the inner and outer sleeve portions when assembled in an operational position. The second bore is effective to allow rotation of the outer sleeve portion about the inner sleeve portion when the first inner end sections of the first set of opposed leg members are not disposed within said pair of opposed slots. In a particular application of the invention, the first bore has a size and shape that is effective to receive a lower end section of a vertically disposed object having a vertical support member selected from the group consisting of a tree trunk, a sign post, a flag pole, a display rack and the like.

A further feature of the stand assembly of the invention is directed to a structural configuration that includes a fuel burner wherein the first bore of the inner sleeve portion defines a combustion chamber. The fuel burner includes means for introducing fuel into the combustion chamber to direct flame upwardly and out the upper end of the hub section. In a specific embodiment of the fuel burning assembly, the means for introducing fuel includes a fuel supply line fixedly attached to the lower end of the inner male section. The fuel burner includes a nozzle structure disposed at an inner end of the supply line, and means for connecting a fuel supply to an outer distal end of the supply line to direct fuel to the nozzle structure. When assembled, the nozzle structure is disposed below the combustion chamber of the inner sleeve portion.

Another feature of the invention is directed to a stand assembly for a fuel burning cooker that includes a pair of outwardly extending, opposed leg members fixed to the outer peripheral surface of an inner portion and a pair of outwardly extending, opposed leg members fixed to the outer peripheral surface of an outer sleeve portion of the hub section. Each leg member includes a foot section effective to rest the stand assembly on a substantially horizontal surface, a container support section having and a top portion that is effective to support a cooking pot or pan when assembled together. In a specific embodiment, the inner and outer sleeve portions of the hub section are cylindrical and the top portion of the container support sections inclines inwardly toward the center of the assembly and supports a cooking pot or pan above the hub section to receive heat from an upwardly directed flame.

Another feature of the fuel burner for the stand assembly of the invention includes means for controlling distribution of flame outwardly directed from the upper end of the hub section. The means for controlling distribution of flame includes a disk member upwardly spaced from the upper end of the hub section, and means for disposing the disk member over the open end of the hub section to distribute the flame around the outer periphery of the disk member. Differing means for disposing the disk member over the open end of the hub section are contemplated.

In a specific embodiment of the flame distribution means, the disk member is circular and mounted an upwardly spaced distance of about ½ inch from the upper end of the hub section. The disk member has an outer edge circumferential size that is effective to be substantially equal to the outer diameter of the outer sleeve portion. The means for disposing the disk member over the hub section includes a handle member that is attached to an edge section of the disk member and is rotatably disposed in an elongated tube that is mounted to the second outer surface. The elongated tube has a delimited length so that an outer end section of the handle member extends below the elongated tube by an amount sufficient to be effective to manually grasp and rotate the handle for rotatably moving the disk member across the open end hub section.

In another specific embodiment, the support assembly of the invention may be used to display an object such as a Christmas tree, a flag, a sign such as an advertising sign, or a display rack. In such an instance, the bore of the hollow inner sleeve portion is shaped to receive the lower end section of a tree trunk, a flag pole, a sign post or a display rack. This may include an upwardly directed extension tube fitted to the hub section and having a plurality of radially extending threaded bore holes circumferentially equally spaced with respect to each other. Elongated screws or tightening bolts threadingly mate with the bore holes to engage and fix the lower end of a tree trunk, flag pole, sign post or display rack in a free-standing position.

BRIEF DESCRIPTION OF THE DRAWINGS

The above-mentioned and other features, aspects, and advantages of the present invention will be better understood from the following detailed description of specific embodiments of the invention in conjunction with the drawings, in which.

DETAILED DESCRIPTION OF THE INVENTION

Figure 1:
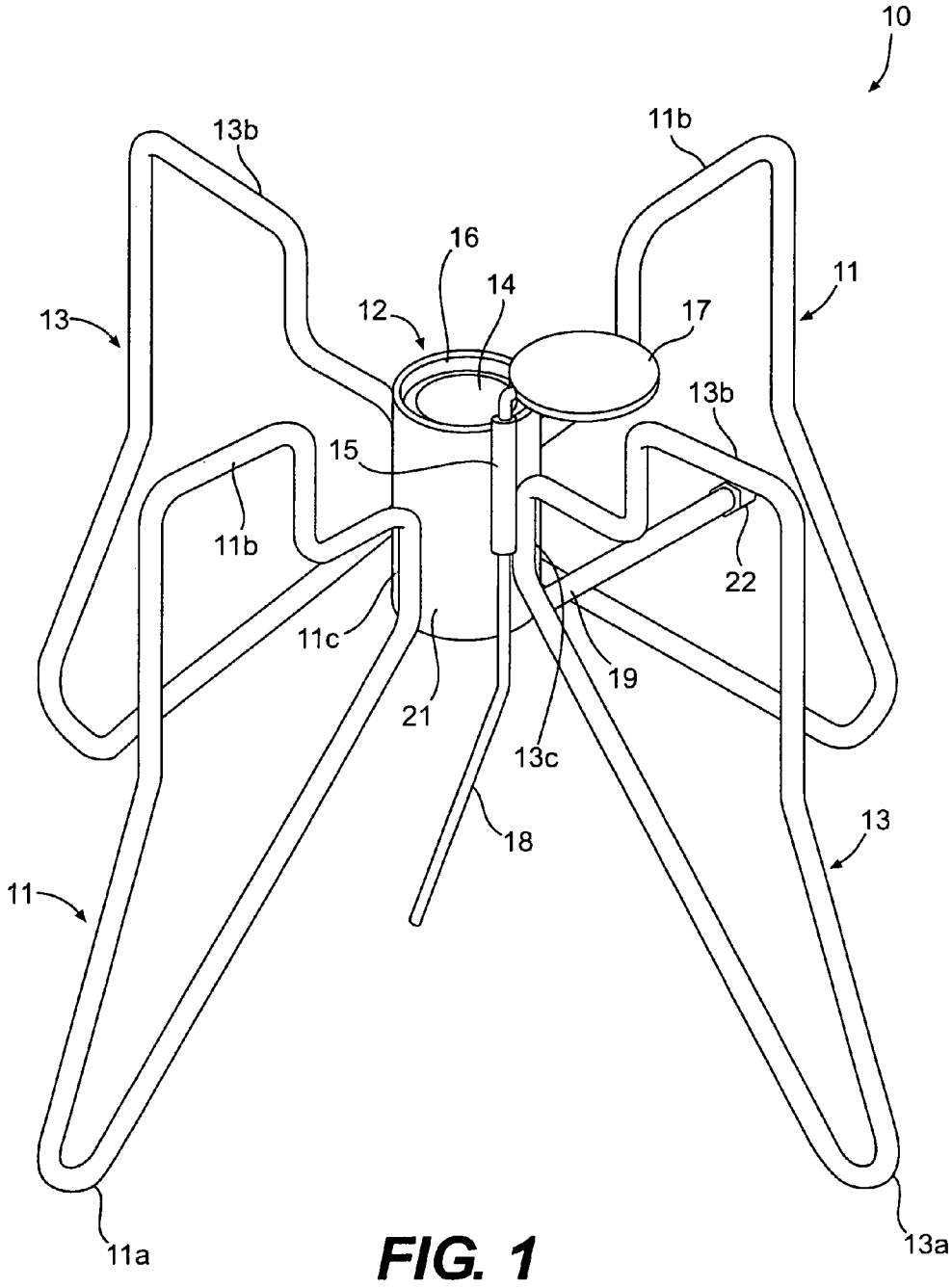
FIG. 1 is a perspective view of a support assembly for a fuel burning cooker of the present invention.
Figure 2:
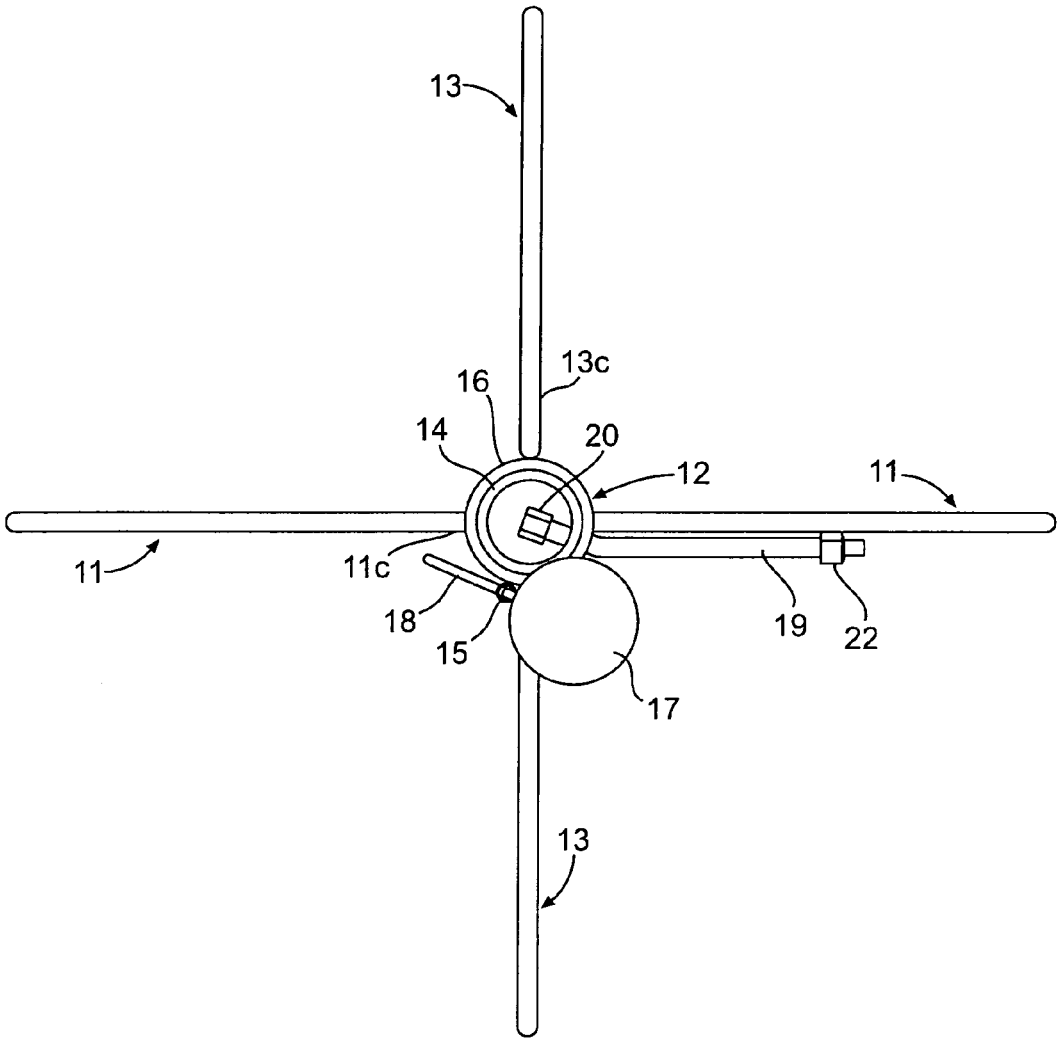
FIG. 2 is a top plan view of the support assembly for a fuel burning cooker of the invention as shown in FIG. 1.
Figure 3:
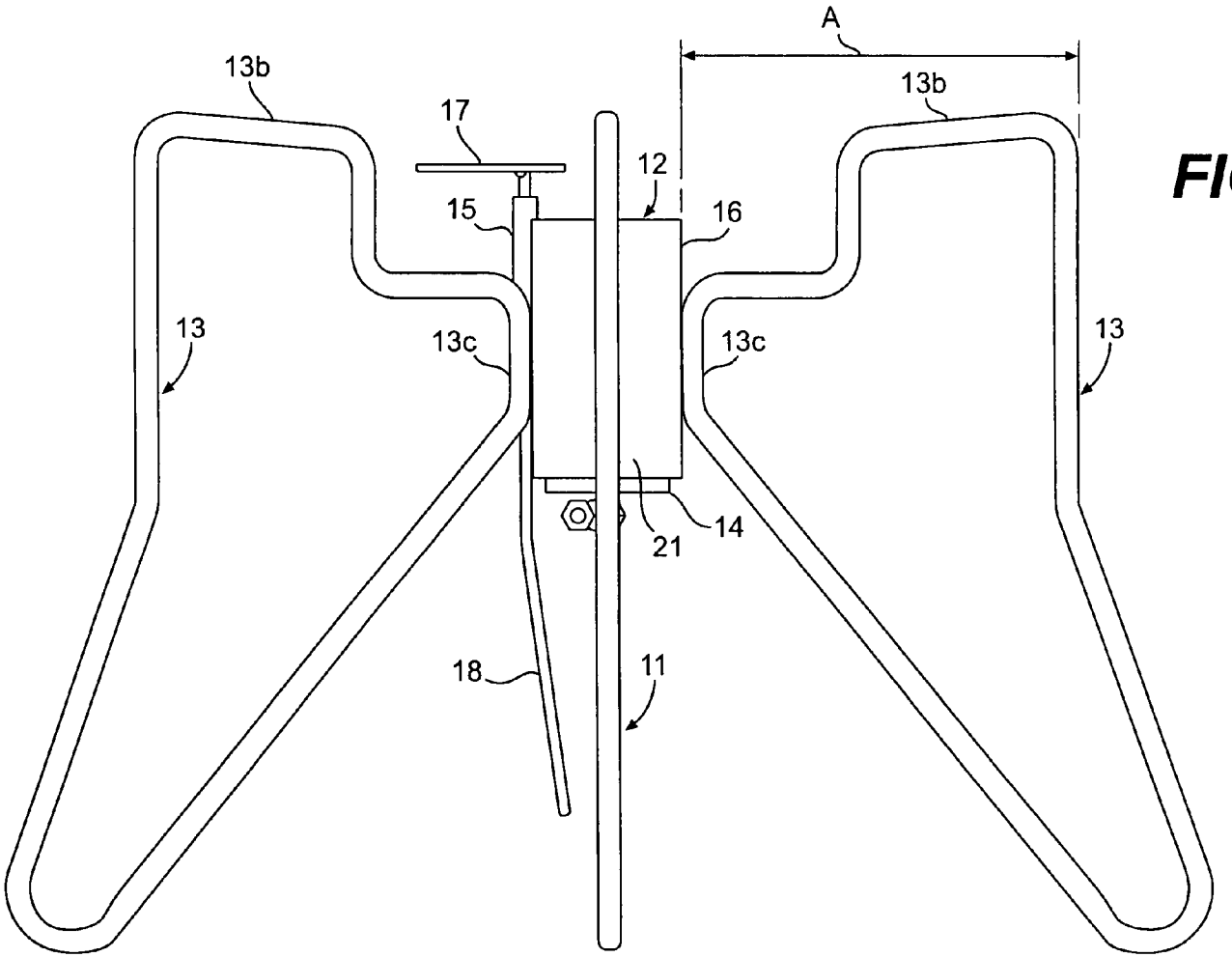
FIG. 3 is a side elevational view of the support assembly for a fuel burning cooker as shown in FIG. 1.
Figure 4:
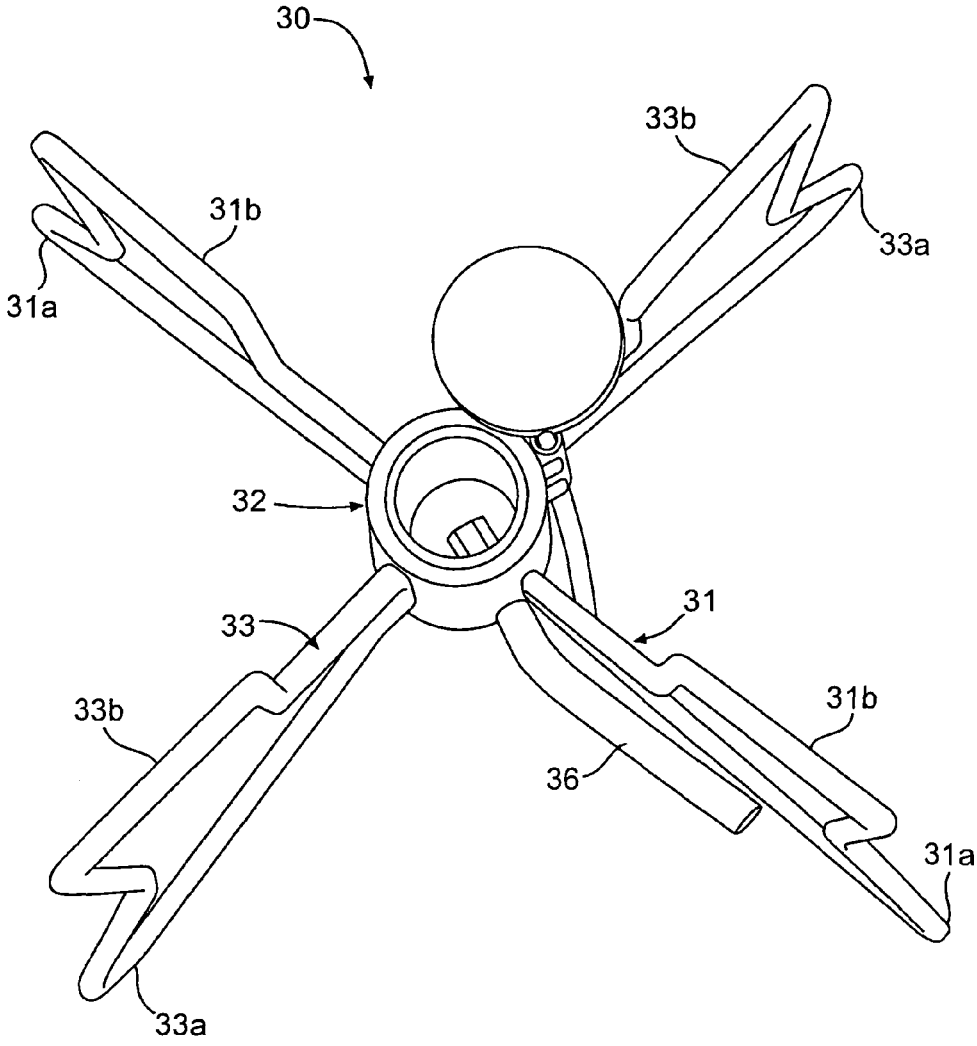
FIG. 4 is a perspective view of another embodiment of a support assembly for a fuel burning cooker of the invention with the outer sleeve portion disposed within the inner sleeve portion and positioned 180° from how the outer sleeve portion is shown in the FIG. 1 embodiment.

FIGS. 1-3 show a support assembly for a fuel burning cooker, generally designated 10, including a hub section, generally designated 12, having an upper end and a lower end, a hollow inner sleeve portion 14 with a first bore and a first outer peripheral surface, and a hollow outer sleeve portion 16 with a second outer peripheral surface and being effective to removably receive inner sleeve portion 14. As evident in the drawings, inner sleeve portion 14 may be separated from outer sleeve portion 16, and hub section 12 has an unobstructed continuous opening through the entire length thereof. Two (2) pair of opposed leg members 11 and 13 include single inner end sections 11*c* and 13*c* and extend outwardly from hub section 12; inner end sections 11*c* and 13*c* are fixedly attached to respective outer peripheral surfaces of sleeve portions 14 and 16; and leg members 11 and 13 have respective container support sections with top portions 11*b* and 13*b* effective to support a cooking pot or pan when assembled together. Each leg member 11 and 13 has respective foot sections 11*a* and 13*a* effective to rest assembly 10 on a substantially horizontal surface.

In this embodiment, container support top portions 11*b* and 13*b* incline inwardly toward the center of assembly 10 and support a cooking pot or pan above hub section 12 to receive heat from an upwardly directed flame. The distance A in FIG. 3 from the outer edge of leg members 11 and 13 to the outer peripheral surface of sleeve portion 16 measures about six (6) inches. Leg members 11 and 13, composed of ⅜ inch black iron having a circular cross-section, are welded to respective inner and outer sleeve portions 14 and 16 that are composed of black iron pipe sections. Outer sleeve portion 16 has an outside diameter of about 2¼ inch and an inside diameter of about 1⅞ inch, and inner sleeve portion 14 has an outside diameter of about 1 13/16 inch and an inside diameter of about 1 7/16 inch. Disclosed embodiments of the assembly have an overall height of about 13 inches and may use a ⅜ inch black iron having a square cross-section.

Outer sleeve portion 16 includes a pair of opposed slots 21 circumferentially spaced at about 90° from the second set of opposed leg members 13. Slots 21 extend upwardly from the lower end of outer sleeve portion 16 and have a size sufficient to removably, slidingly receive the entire single inner end section 11*c* of the first set of opposed leg members 11 as shown. Outer sleeve portion 16 with slots 21 is thus a female assembly unit and inner sleeve portion 14 with leg members 11 is a male assembly unit. Leg members 11 and 13 provide a four-legged support structure for burner assembly 10 and a resting place for a cooking container such as a pot or pan when inner sleeve portion 14 is contiguously and slidingly located within outer sleeve portion 16 and end sections 11*c* of said opposed leg members 11 are disposed within the pair of opposed slots 21 as shown.

Fuel supply pipe 19 disposed at the lower end of hub section 12 is welded to the bottom or lower end of inner sleeve portion 14 and includes inner nozzle end 20 and outer connector end 22 for attachment to a supply of fuel such as butane or propane. Nozzle end 20 is disposed immediately below the open end of inner sleeve portion 14 to introduce fuel into the bore chamber of hollow sleeve portion 14 for directing flame upwardly and out the upper end of hub section 12.

Elongated holding tube 15 fixedly attached to the outer surface of sleeve portion 16 pivotally holds adjusting element 18 mounted at one end to flame distributing disk 17 having a diameter substantially equal to the outer diameter of sleeve portion 16. A handle section at the other end of element 18 is used to rotate disk 17 about ½ inch above the open upper end of hub section 12 for controlling distribution of the upwardly directed flame outwardly up to 10 inches from the center of hub section 12. Holding tube 15 is located between a slot 21 and leg member 13 so that it is unnecessary to insert inner sleeve portion 14 into outer sleeve portion 16 in the same manner each time the burner structure is assembled. Opposed leg members 11 of the male unit may slide into either of opposed slots 21 of the female unit.

FIGS. 4 through 6B show a fuel burning cooker assembly, generally designated 30, that includes a hub section, generally designated 32, from which two pair of opposed leg members 31 and 33 extend outwardly. This embodiment is constructed with dimensions like the first embodiment while having slightly differently shaped leg members 31 and 33 and fuel supply line 36. Leg members 31 and 33 have respective foot sections 31*a* and 33*a* that rest on a substantially horizontal surface to maintain assembly 30 upright, and respective container support top portions 31*b* and 33*b* for supporting a cooking container when assembled.

Figure 5:
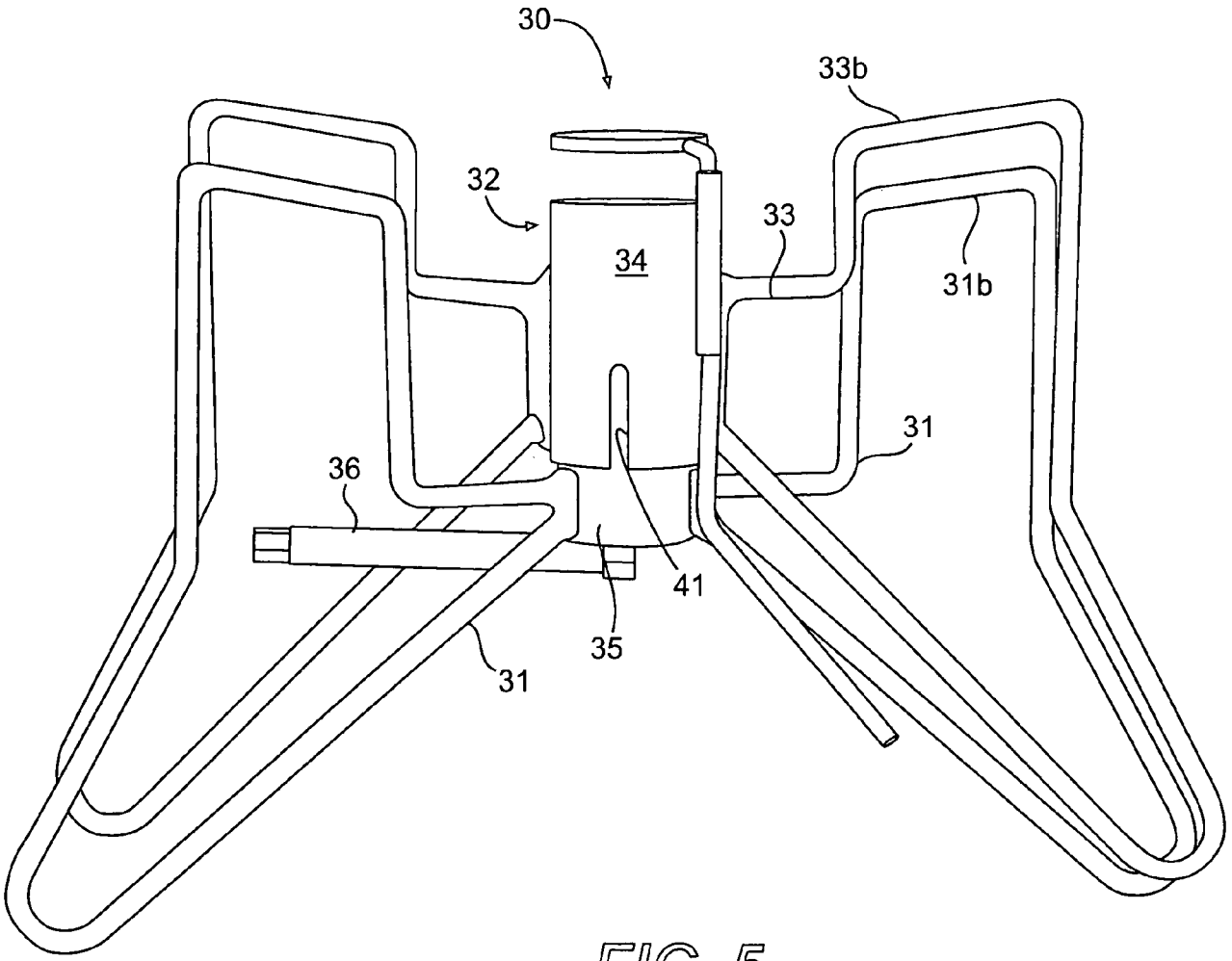
FIG. 5 is a perspective view of the support assembly for a fuel burning cooker of the invention as shown in FIG. 4 with the leg members rotated to a stowing position for storage.
Figure 6A:
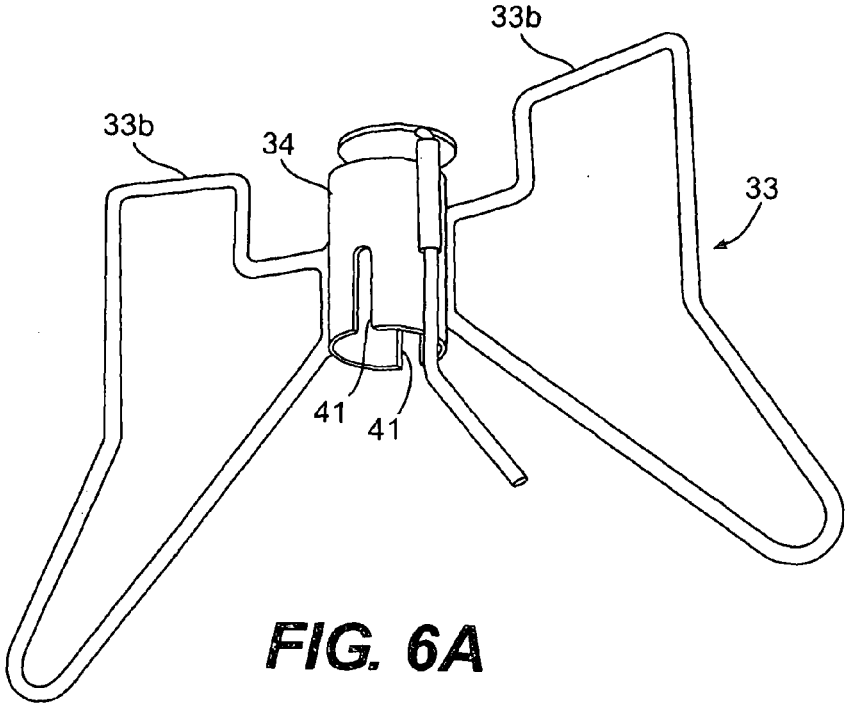
FIGS. 6A and 6B are perspective views of the support assembly for a fuel burning cooker of the invention as shown in FIG. 4 with its two leg member and hub components individually separated.
Figure 6B:
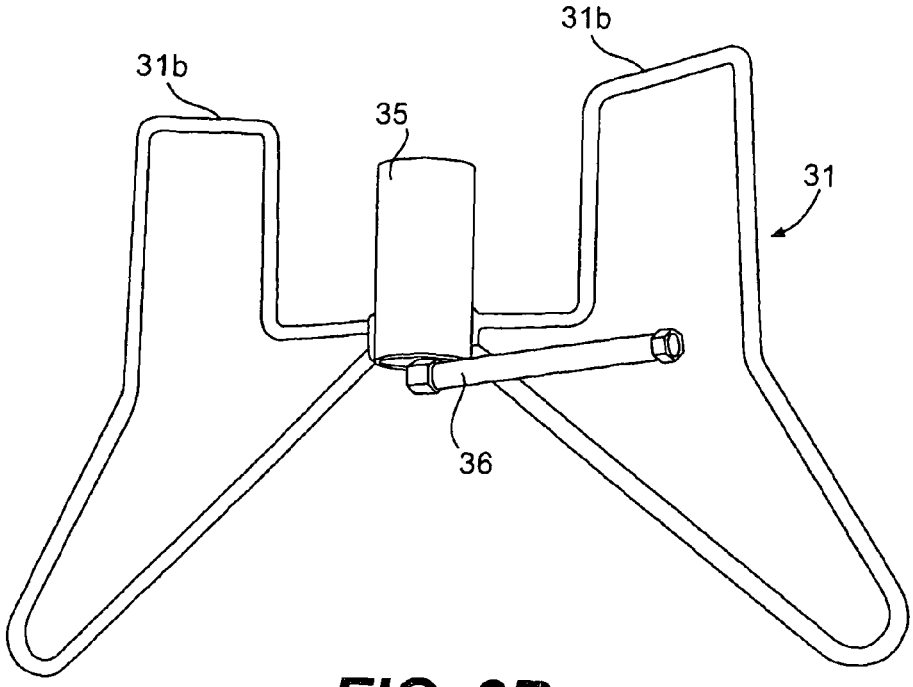

FIG. 5 shows the female unit of burner assembly 30 moved upwardly with respect to the male unit so that leg members 31 of the male unit are removed from slots 41 of the female unit. The outer and inner sleeve portions 34 and 35 are rotated with respect to each other to place leg members 31 and 33 in a folded position. As shown, container support top portions 31*b* and 33*b* incline inwardly toward the center of assembly 30 and support a cooking container such as pot or pan above hub section 32 when assembled as in FIG. 4. FIGS. 6A and 6B show female and male unit components comprising burner assembly 30 each individually separated and standing alone.

Figure 7A:
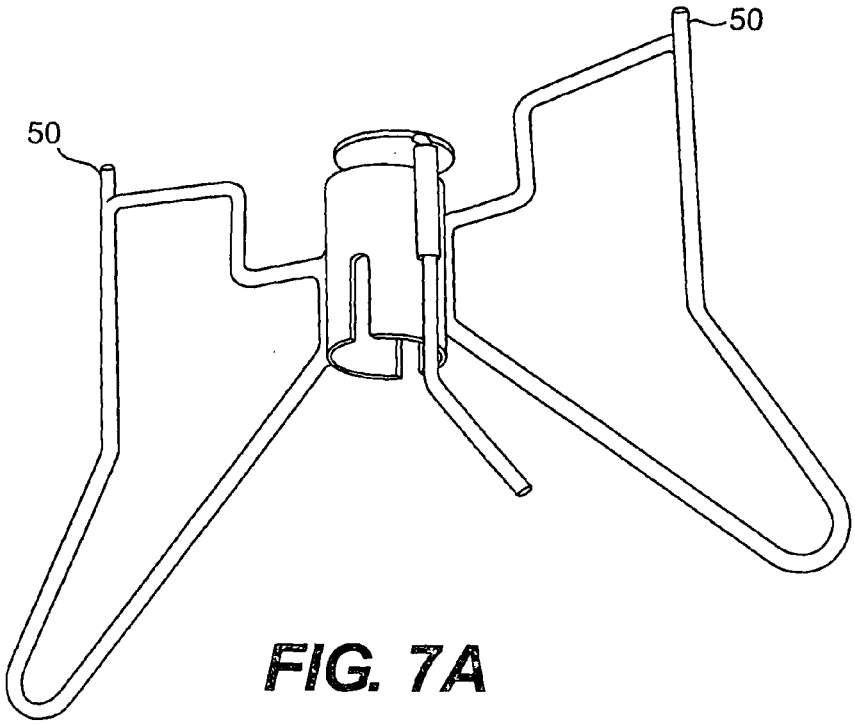
FIGS. 7A and 7B are perspective views of another embodiment of a support assembly for a fuel burning cooker of the invention shown with its two opposed leg member and hub components individually separated and having safety stops for containing a large cooking pot.
Figure 7B:
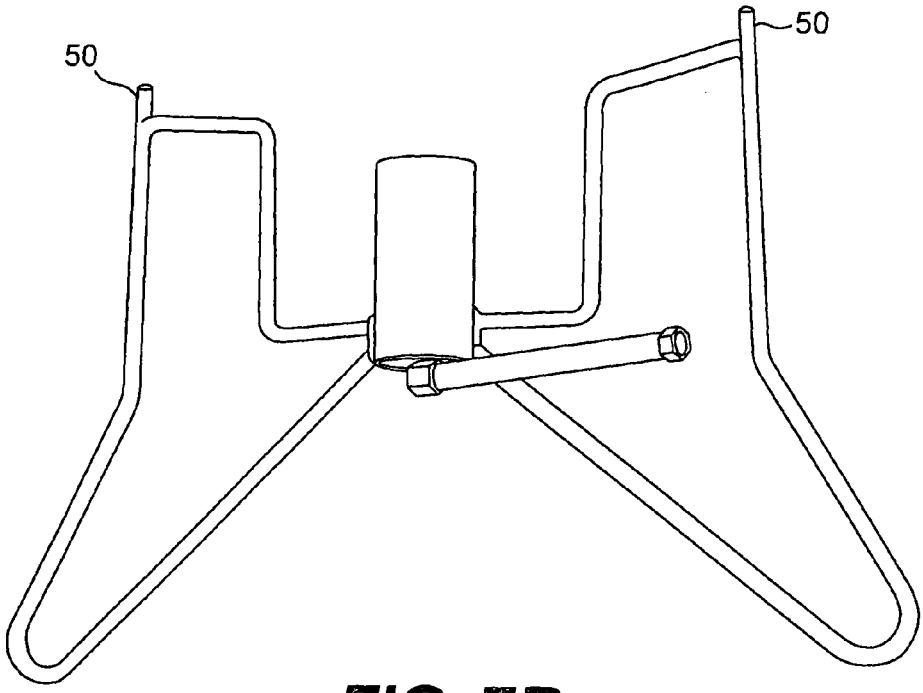
Figure 8A:
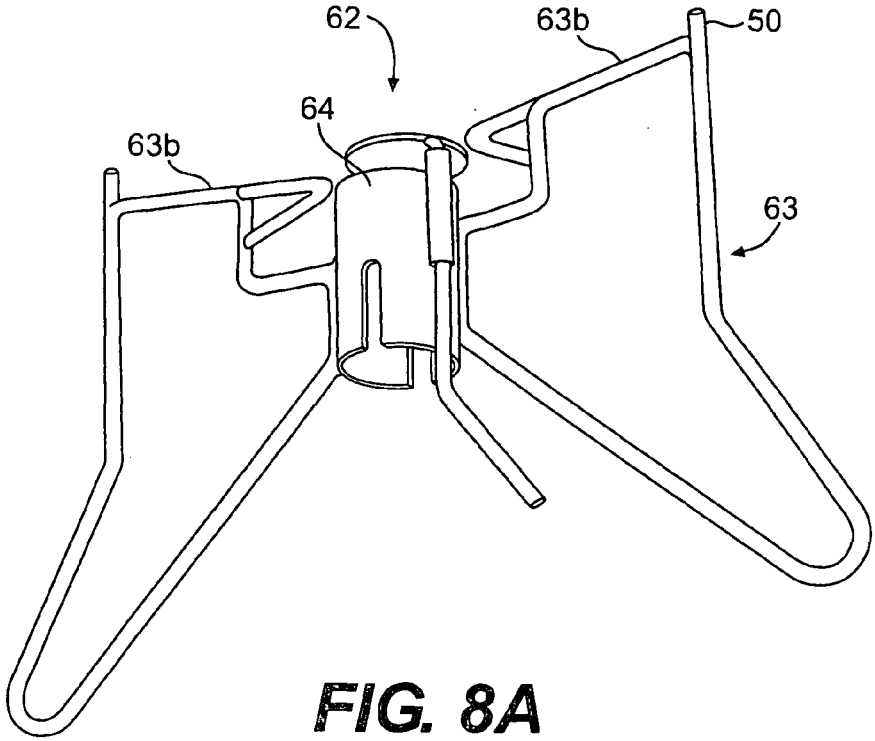
FIGS. 8A and 8B are perspective views of another embodiment of a support assembly for a fuel burning cooker of the invention shown with its two opposed leg member and hub components individually separated and having inner extensions for accommodating a smaller cooking pot.
Figure 8B:
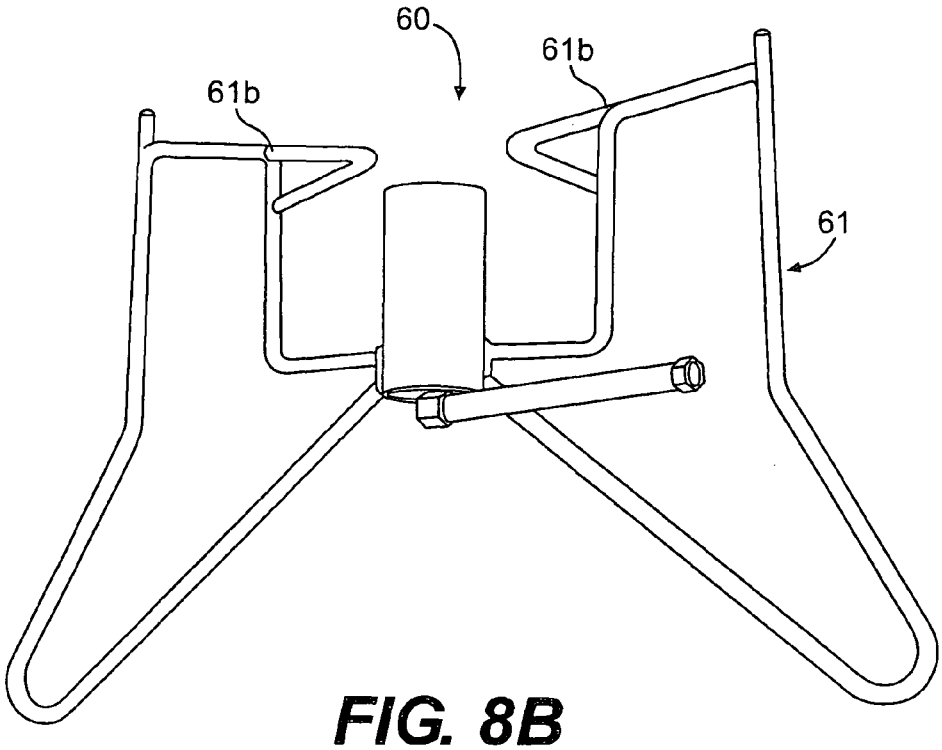

In another embodiment, FIGS. 7A and 7B respectively show female and male units identical to the female and male units of FIGS. 6A and 6B except for the safety stops 50 that assist in positioning and maintaining cooking pots and pans in place during use of the stand assembly. The embodiments of female unit 62 (FIG. 8A) and male unit 60 (FIG. 8B) are identical to those units of FIGS. 7A and 7B except that container support top portions 61*b* and 63*b* extend inwardly to the outer dimension of the outer peripheral surface of outer sleeve portion 64. Thus, top portions 61*b* and 63*b* are about six (6) inches in length measured from the outer edge of leg members 61 and 63 to the outer peripheral surface of outer sleeve portion 64 so that smaller diameter containers may be used for cooking without the possibility of an accidental spill of their contents.

Figure 9A:
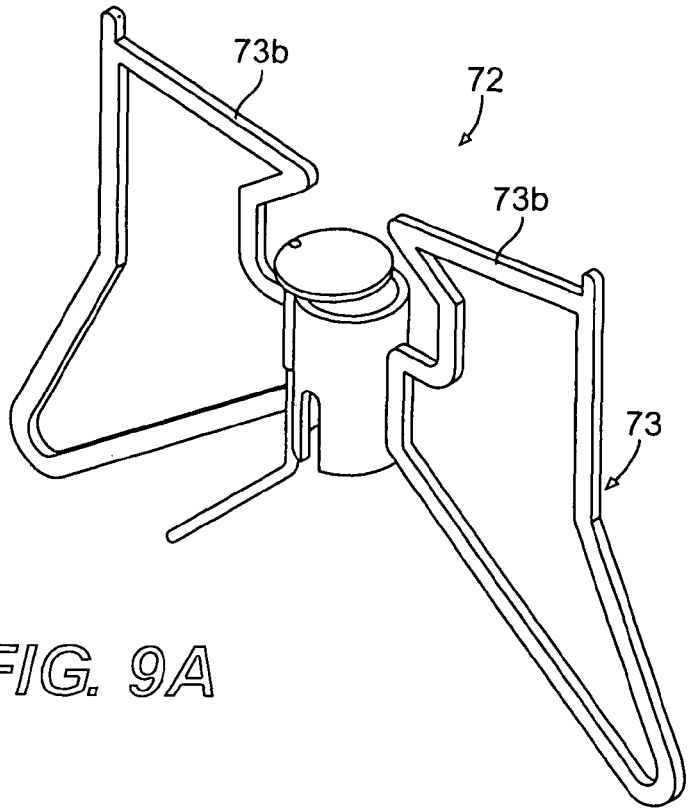
FIGS. 9A and 9B are perspective views of a further embodiment of a support assembly for a fuel burning cooker of the invention composed of a rectangular cross-sectional wire with its two opposed leg member and hub components individually separated and having inner extensions for smaller cooking pots.
Figure 9B:
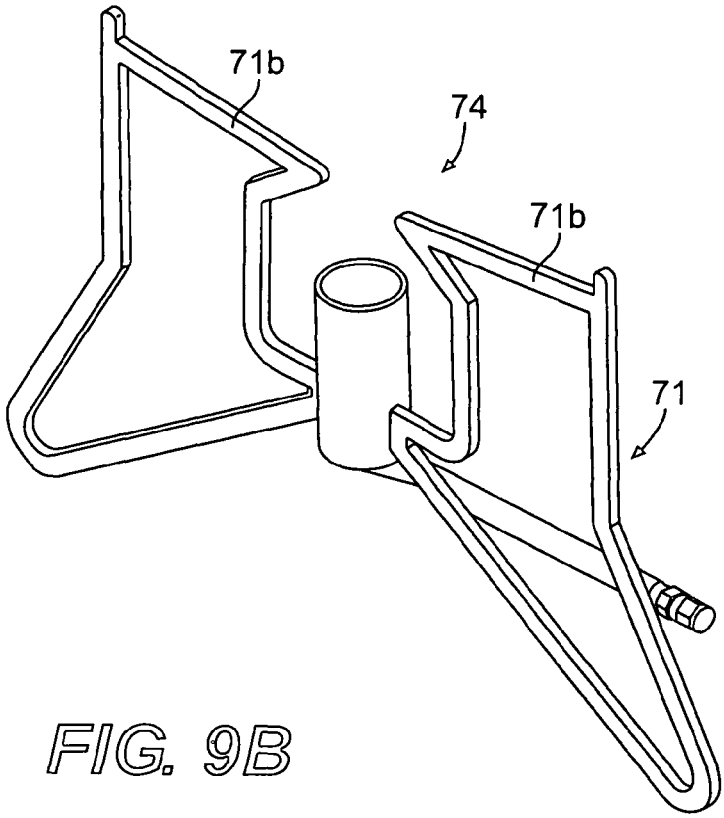
Figure 10:
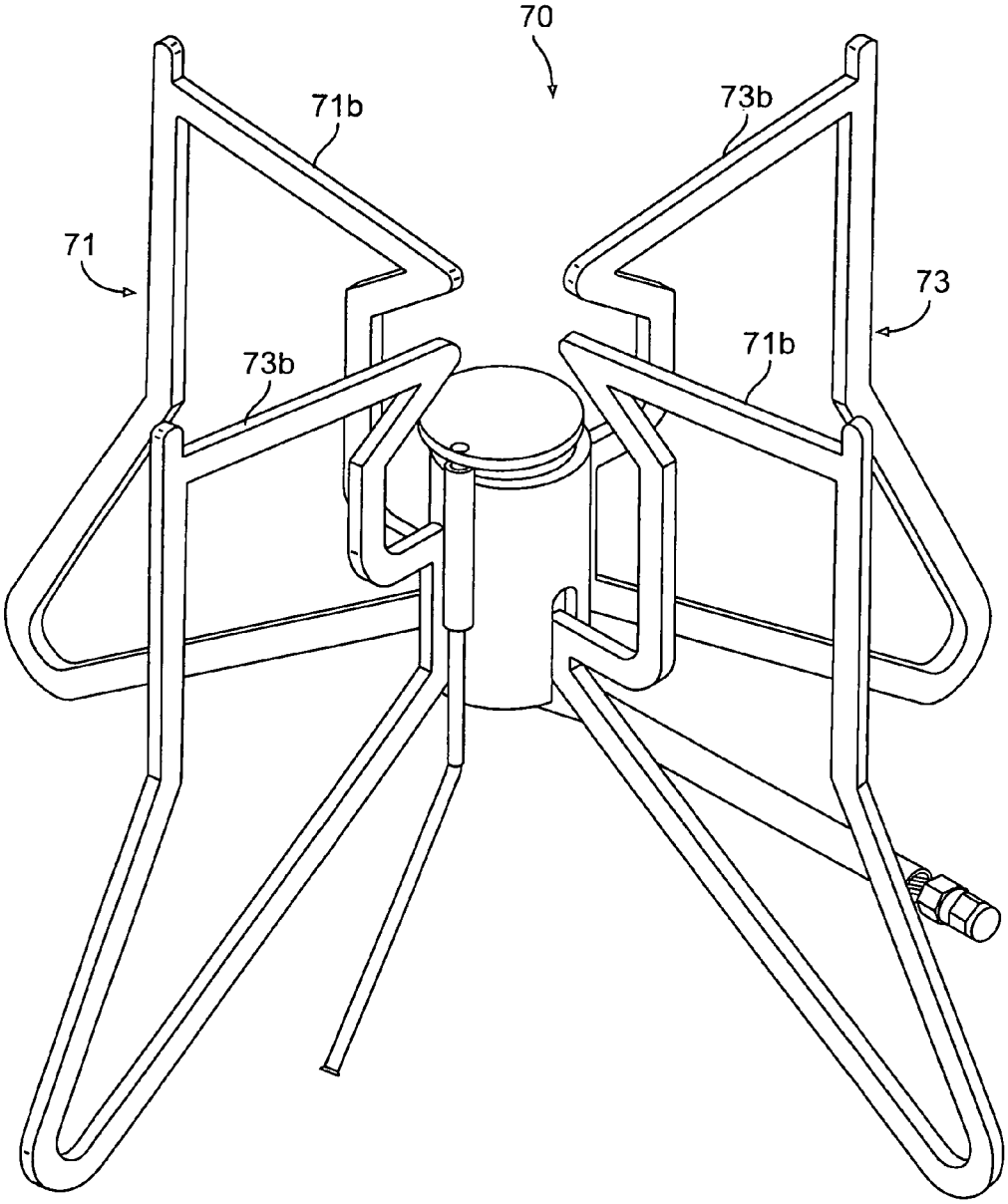
FIG. 10 is a perspective view of a support assembly for a fuel burning cooker of the present invention as shown assembled with the components of FIGS. 9A and 9B.

In a further embodiment, FIG. 10 shows assembled stand assembly, generally designated 70, having leg members 71 (FIG. 9B) and 73 (FIG. 9A) that are composed of ⅜ inch black iron having a square cross-section and are welded to respective inner and outer sleeve portions as in earlier embodiments. Container support top portions 71*b* and 73*b* extend inwardly to the outer dimension of the outer peripheral surface of the outer sleeve portion as shown.

While leg members of the collapsible or knock-down assemblies shown in FIGS. 1 through 8 are made of ⅜ inch round bar, construction of the assembly units may be of flat bar, round tubing, square tubing, three-sided tubing, or angle iron. For smaller applications such as stoves or burners designed for camping and hiking, inner and outer sleeve portions and their respective leg members may be in smaller sizes and composed of appropriate lightweight materials.

Figure 11A:
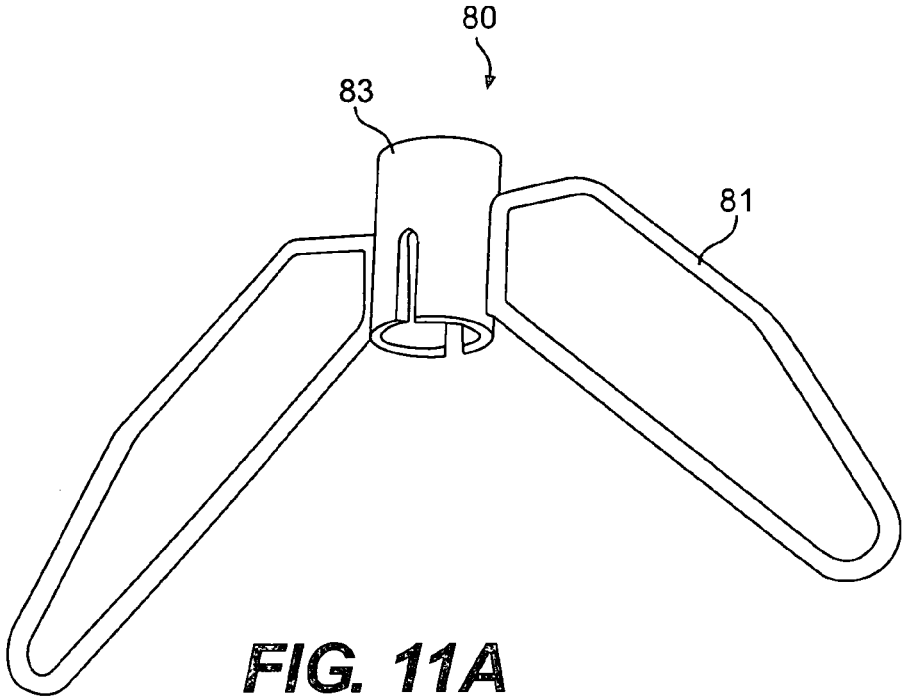
FIGS. 11A and 11B are perspective views of a stand assembly for supporting vertically disposed free-standing objects showing hub components individually separated with a first bore having a size and shape effective to receive a lower end section of a vertical support member such as a tree trunk, a sign post, a flag pole, or a display rack.
Figure 11B:
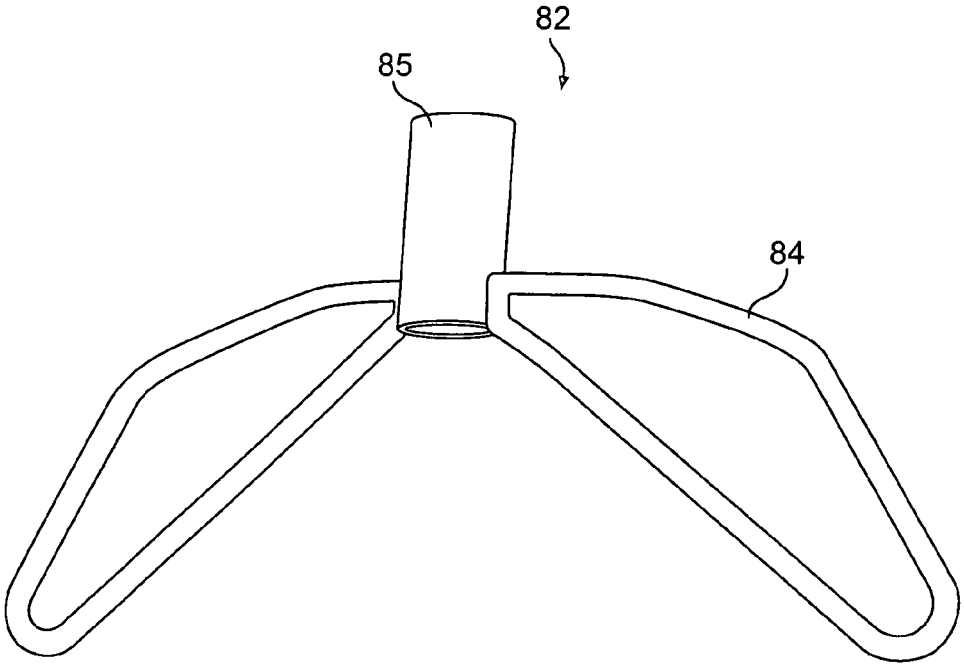

FIGS. 11A and 11B respectively show female and male assembly components 80 and 82 of a collapsible or knock-down stand assembly for supporting a free-standing object having a vertical support member in a generally vertical orientation. Opposed leg members 81 and 84 are fixed to respective outer sleeve portion 83 and inner sleeve portion 85 that slidingly fit together in the same manner as described with respect to the fuel burning cooker assembly of the invention. Outer sleeve portion 83 and inner sleeve portion 85 have a shape and size effective to receive a lower end section of vertically disposed objects such as Christmas trees, flags, signs, display racks, and the like. Depending on the particular application, the stand assembly may be used in conjunction with other elements such as containers for water used by a tree. Such support stand assemblies do not include a fuel supply line, flame distributing means, or upper leg element sections for supporting cooking pots and pans above the hub section.

While the stand assembly for supporting free-standing objects has been shown and described in detail, it is obvious that this invention is not to be considered as limited to the exact form disclosed, and that changes in detail and construction may be made therein within the scope of the invention without departing from the spirit thereof.

I claim:

1. A stand assembly for supporting vertically disposed free-standing objects, said assembly comprising:

a) a hub section including a hollow inner sleeve portion and a hollow outer sleeve portion each portion having an upper open end and a lower open end to form an unobstructed continuous opening through the entire length of said hub section, said hollow inner sleeve portion having a first bore and a first outer peripheral surface, and said hollow outer sleeve portion having a second outer peripheral surface and a second bore effective to removably receive said inner sleeve portion whereby said inner and outer sleeve portions may be separated; and b) support leg means including inner end sections fixedly connected to said outer peripheral surfaces of said hollow inner and outer sleeve portions of the hub section for upholding the hub section in a vertical disposition;

c) said support leg means including a first set of opposed leg members having first single inner end sections fixed to said first outer peripheral surface of said inner sleeve portion and radially extending outwardly therefrom, and a second set of opposed leg members having second inner end sections fixed to said second outer peripheral surface of said outer sleeve portion and radially extending outwardly therefrom;

d) said outer sleeve portion including a pair of opposed slots peripherally spaced from said second set of opposed leg members and extending upwardly from said lower end of the outer sleeve portion for removably receiving said first single inner end sections of said first set of opposed leg members to provide a four-legged stand structure when said inner sleeve portion is located within said outer sleeve portion and the entire said first single inner end sections of said first set of opposed leg members are disposed within said pair of opposed slots, e) said stand assembly is effective to be assembled and disassembled without tools and once assembled said assembly stays fixed in place in an operational position without fastening means for supporting a free-standing object.

2. An assembly as defined in claim 1, wherein said inner sleeve portion and said outer sleeve portion are cylindrical and said second bore is effective to allow rotation of said outer sleeve portion about said inner sleeve portion when said outer sleeve portion receives said inner sleeve portion and said first single inner end sections of said first set of opposed leg members are not disposed within said pair of opposed slots.

3. An assembly as defined in claim 2, wherein said first outer surface of the inner sleeve portion has an outer diameter of a length sufficient to slidingly fit into said second bore of the outer sleeve portion so that no substantial play exists between the inner and outer sleeve portions when assembled in said operational position.

4. An assembly as defined in claim 1, wherein said pair of opposed slots are peripherally spaced from said second set of opposed leg members by about 90° and have a width effective to slidingly receive said first inner end sections of said first set of opposed leg members so that no substantial play exists between the slots and the first single inner end sections of said first set of opposed leg members when assembled in an operational position.

5. An assembly as defined in claim 1, wherein said first bore has a size and shape that is effective to receive a lower end section of a vertically disposed object having a vertical support member selected from the group consisting of a tree trunk, a sign post, a flag pole, and a display rack.

6. A stand assembly for supporting vertically disposed free-standing objects, said assembly comprising:

a) a hub section including a hollow inner sleeve portion and a hollow outer sleeve portion each portion having an upper open end and a lower open end to form an unobstructed continuous opening through the entire length of said hub section, said hollow inner sleeve portion having a first bore and a first outer peripheral surface, and said hollow outer sleeve portion having a second outer peripheral surface and a second bore effective to removably receive said inner sleeve portion whereby said inner and outer sleeve portions may be separated; and b) a support leg means including inner end sections fixedly connected to said outer peripheral surfaces of said hollow inner and outer sleeve portions of the hub section for upholding the hub section in a vertical disposition;

c) said support leg means including a first set of opposed leg members having first single inner end sections fixed to said first outer peripheral surface of said inner sleeve portion and radially extending outwardly therefrom, and a second set of opposed leg members having second inner end sections fixed to said second outer peripheral surface of said outer sleeve portion and radially extending outwardly therefrom;

d) said outer sleeve portion including a pair of opposed slots peripherally spaced from said second set of opposed leg members and extending upwardly from said lower end of the outer sleeve portion for removably receiving said first single inner end sections of said first set of opposed leg members to provide a four-legged stand structure when said inner sleeve portion is located within said outer sleeve portion and the entire said first single inner end sections of said first set of opposed leg members are disposed within said pair of opposed slots, e) said stand assembly is effective to be assembled and disassembled without tools and once assembled said assembly stays fixed in place in an operational position without fastening means for supporting a free-standing object f) said lower end of the said hub section includes a fuel burner and said inner bore defines a combustion chamber, g) said fuel burner includes means for introducing fuel into the combustion chamber for directing flame upwardly and out the upper end of said hub section.

7. An assembly as defined in claim 6, wherein said means for introducing fuel includes a fuel supply line attached to the lower end of the inner sleeve portion, and said fuel burner includes a nozzle structure at an inner end of the supply line and means for connecting a fuel supply to an outer distal end of the supply line to direct fuel to the nozzle structure that is disposed below said combustion chamber.

8. An assembly as defined in claim 7, wherein said inner sleeve portion and said outer sleeve portion of the hub section are cylindrical and said second bore is effective to allow rotation of said outer sleeve portion about said inner sleeve portion when said outer sleeve portion receives said inner sleeve portion and said first single inner end sections of said first set of opposed leg members are not disposed within said pair of opposed slots of said outer sleeve portion.

9. An assembly as defined in claim 6, wherein each leg member includes a foot section effective to rest the stand assembly on a substantially horizontal surface, and a container support section having a top portion that is effective to support a cooking container when assembled together.

10. An assembly as defined in claim 9, wherein said inner sleeve portion and said outer sleeve portion of the hub section are cylindrical, and said top portion of said container support sections inclines inwardly toward the center of the assembly and supports a cooking pot or pan above the hub section to receive heat from an upwardly directed flame.

11. An assembly as defined in claim 6, wherein said fuel burner includes means for controlling distribution of flame outwardly directed from said upper end of the hub section, said means for controlling distribution of flame includes a disk member mounted upwardly spaced from the upper end of said hub section and means for disposing the disk member over the open end of the hub section to distribute the flame around the outer periphery of the disk member.

12. An assembly as defined in claim 11, wherein said disk member is effective to be upwardly spaced from the upper end of said hub section by a distance of about ½ inch for controlling distribution of the upwardly directed flame outwardly up to 10 inches from the center of said hub section.

13. An assembly as defined in claim 11, wherein said disk member is circular having an outer edge circumferential size that is effective to be substantially equal to an outer diameter of the outer sleeve portion, said means for disposing the disk member includes a handle member attached to an edge section of the disk member and rotatably disposed in an elongated tube that is mounted to said second outer surface, said elongated tube having a delimited length so that an outer end section of the handle member extends below the elongated tube by an amount sufficient to be effective to manually grasp and rotate the handle for rotatably moving the disk member across the open end section.

14. A stand assembly for supporting vertically disposed free-standing objects, said assembly comprising:

a) a cylindrical hub section including a hollow inner sleeve portion and a hollow outer sleeve portion each portion having an upper open end and a lower open end to form an unobstructed continuous opening through the entire length of said hub section and a fuel burner at a said lower open end, said inner sleeve portion having a first bore defining a combustion chamber and a first outer surface, and a outer sleeve portion having a second outer surface and a second bore effective to removably receive said inner sleeve portion whereby said inner and outer sleeve portions may be separated;

b) said fuel burner including means for introducing fuel into the combustion chamber for directing flame upwardly and out the upper open end of the hub section;

c) support leg means including inner end sections fixedly connected to the hub section for upholding the hub section in a vertical disposition and including a first set of opposed leg members having first single inner end sections fixed to said first outer surface and radially extending outwardly therefrom, and a second set of opposed leg members having second inner end sections fixed to said second outer surface and radially extending outwardly therefrom;

d) each leg member including a foot section effective to rest the stand assembly in an operational position on a substantially horizontal surface, and a container support section having a top portion that is effective to support a cooking container above the hub section to receive heat from an upwardly directed flame when assembled together;

e) said outer sleeve portion including a pair of opposed slots circumferentially spaced from said second set of opposed leg members and extending upwardly from said lower end of the outer sleeve portion for removably receiving said first single inner end sections of said first set of opposed leg members to provide a four-legged stand structure when said inner sleeve portion is located within said outer sleeve portion and the entire said first single inner end sections of said first set of opposed leg members are disposed within said pair of opposed slots;

f) said fuel burner including means for controlling distribution of flame outwardly directed from said upper end of the hub section, g) said means for controlling distribution of flame including a disk member mounted upwardly spaced from the upper end of said hub section and means for disposing the disk member over the open end of the hub section to distribute the flame around the outer periphery of the disk member.

15. An assembly as defined in claim 14, wherein said top portion of said container support sections inclines inwardly toward the center of the assembly.

16. An assembly as defined in claim 14, wherein said disk member is upwardly spaced from the upper end of said hub section by a distance of about ½ inch.

17. An assembly as defined in claim 14, wherein said disk member is circular having an outer edge circumferential size that is effective to be substantially equal to an outer diameter of the outer sleeve portion, said means for disposing the disk member includes a handle member attached to an edge section of the disk member and rotatably disposed in an elongated tube that is mounted to said second outer surface, said elongated tube having a delimited length so that an outer end section of the handle member extends below the elongated tube by an amount sufficient to manually grasp and rotate the handle for rotatably moving the disk member across the open end section.

18. An assembly as defined in claim 14, wherein said first outer surface of the inner sleeve portion has an outer diameter of a length sufficient to slidingly fit into said second bore of the outer sleeve portion so that no substantial play exists between the inner and outer sleeve portions when assembled in said operational position.

19. An assembly as defined in claim 14, wherein said pair of opposed slots are circumferentially spaced from said second set of opposed leg members by about 90° and have a width effective to slidingly receive said first set of opposed leg members so that no substantial play exists between the slots and the inner end sections of said first set of opposed leg members when assembled in an operational position.

* * * * *